US009357828B2

(12) United States Patent
Onessimo et al.

(10) Patent No.: US 9,357,828 B2
(45) **Date of Patent: *Jun. 7, 2016**

(54) BAG THAT DISTRIBUTES WEIGHT OVER THE BACK OF A PERSON

(71) Applicants: Shawn Onessimo, Methuen, MA (US); William Overstreet, Lowell, MA (US)

(72) Inventors: Shawn Onessimo, Methuen, MA (US); William Overstreet, Lowell, MA (US)

( * ) Notice: Subject to any disclaimer, the term of this patent is extended or adjusted under 35 U.S.C. 154(b) by 252 days.

This patent is subject to a terminal disclaimer.

(21) Appl. No.: 14/224,935

(22) Filed: Mar. 25, 2014

(65) Prior Publication Data

US 2014/0202815 A1 Jul. 24, 2014

Related U.S. Application Data

(63) Continuation of application No. 12/201,535, filed on Aug. 29, 2008, now Pat. No. 8,708,206.

(51) Int. Cl.

| | |
|---|---|
| ***A45F 3/04*** | (2006.01) |
| ***A45C 5/14*** | (2006.01) |
| ***A45C 3/00*** | (2006.01) |
| *A45F 3/12* | (2006.01) |
| *A45C 13/30* | (2006.01) |
| *A45C 13/00* | (2006.01) |
| *A45F 4/02* | (2006.01) |

(52) U.S. Cl.

CPC ... *A45F 3/04* (2013.01); *A45C 3/00* (2013.01); *A45C 13/00* (2013.01); *A45C 13/30* (2013.01); *A45F 3/12* (2013.01); *A45F 4/02* (2013.01)

(58) Field of Classification Search

CPC ..... A45F 3/04; A45F 3/12; A45F 4/02; A45C 13/30

USPC ..... 224/153, 642, 576, 644; 190/18 A; 206/315.3, 315.7

See application file for complete search history.

(56) References Cited

U.S. PATENT DOCUMENTS

| | | | | | |
|---|---|---|---|---|---|
| 2,401,986 | A | * | 6/1946 | Talbott | B62B 5/0023 224/153 |
| 3,550,997 | A | * | 12/1970 | Strand | A45F 4/02 224/153 |
| 4,045,040 | A | * | 8/1977 | Fails | A01M 31/006 182/118 |
| 4,368,835 | A | * | 1/1983 | Murphy | A45F 3/08 224/153 |

(Continued)

FOREIGN PATENT DOCUMENTS

| | | |
|---|---|---|
| FR | 2645486 | 3/1989 |
| FR | 2775878 | 3/1998 |

(Continued)

OTHER PUBLICATIONS

Travelpro TPro Xtreme Lite Backpack [online] [retrieved on Dec. 11, 2008]; Retrieved from www.ebags.com/travelpro/tpro_xtreme_lite_backpack/product_detail/index.cfm?modelid=97199 (pp. 1-4).

(Continued)

*Primary Examiner* — Justin Larson
*Assistant Examiner* — Lester L Vanterpool
(74) *Attorney, Agent, or Firm* — Fish & Richardson P.C.

(57) ABSTRACT

An apparatus includes a bag to carry one or more objects on the back of a person, and a cushion for connection to a surface of the bag. The cushion is used for making substantially continuous contact with the back when the bag is carried on the back. The apparatus may be a backpack or any other type of bag.

23 Claims, 13 Drawing Sheets

(56) References Cited

U.S. PATENT DOCUMENTS 4,431,121 A * 2/1984 Bensette ..... A01M 31/00 224/153
4,664,395 A * 5/1987 McCoy ..... B62B 5/068 224/153
4,830,245 A * 5/1989 Arakaki ..... A45F 3/04 2/2.5
4,832,362 A 5/1989 Chen
5,131,576 A 7/1992 Turnipseed
5,385,355 A * 1/1995 Hoffman ..... B62D 51/04 280/1.5
5,419,473 A * 5/1995 Lamar ..... A63B 55/00 206/315.3
5,478,097 A 12/1995 Forma
5,573,155 A * 11/1996 Sadler ..... A45F 4/02 224/153
5,588,570 A * 12/1996 Zirbel ..... A45F 4/02 224/155
5,769,431 A 6/1998 Cordova
5,819,999 A * 10/1998 Tennant ..... A45F 4/02 224/153
5,988,465 A * 11/1999 Vitale ..... A45C 15/00 224/153
6,139,033 A 10/2000 Western
6,179,176 B1 * 1/2001 Saggese ..... A45C 5/146 190/18 A
6,186,522 B1 * 2/2001 Weis ..... A45C 5/146 280/37
6,354,477 B1 3/2002 Trummer
6,425,589 B1 7/2002 Wu
6,467,559 B1 * 10/2002 Farrell ..... A63C 11/10 180/180
6,474,524 B1 11/2002 Ivarson et al.
6,631,777 B1 * 10/2003 Thompson ..... B62M 27/02 180/180
6,722,543 B1 4/2004 Fitzgerald et al.
6,925,669 B1 8/2005 Friedman et al.
7,080,732 B2 7/2006 Bonfanti
7,143,912 B2 12/2006 Caneba
7,287,765 B2 10/2007 Murphy et al.
7,387,226 B2 * 6/2008 Porter ..... A45F 3/02 206/315.3
7,717,310 B2 5/2010 Zalinsky et al.
7,934,729 B2 5/2011 Murphy et al.
7,997,591 B2 8/2011 Arthur
2004/0262358 A1 12/2004 Meyer
2005/0121484 A1 * 6/2005 Meyer ..... A63B 55/408 224/629
2006/0240960 A1 * 10/2006 Shahinpoor ..... A63B 69/18 482/121
2007/0075105 A1 * 4/2007 Petrin ..... A45C 5/146 224/153
2007/0096519 A1 5/2007 Conforti
2008/0174078 A1 * 7/2008 Dooley ..... A45F 3/08 280/1.5

FOREIGN PATENT DOCUMENTS

FR 2775878 A1 * 9/1999 ..... A45F 3/08
WO WO 01/24655 4/2001

OTHER PUBLICATIONS

Mountainsmith Covert LX [online] [retrieved on Dec. 11, 2008]; Retrieved from www.ebags.com/mountainsmith/covert_lx/product_detail/index.cfm?modelid=116231 (pp. 1-3).

* cited by examiner

BAG THAT DISTRIBUTES WEIGHT OVER THE BACK OF A PERSON

CROSS-REFERENCE TO RELATED APPLICATIONS

This application is a continuation of and claims priority to U.S. application Ser. No. 12/201,535, filed on Aug. 29, 2008, entitled "BAG THAT DISTRIBUTES WEIGHT OVER THE BACK OF A PERSON," the entire contents of which are hereby incorporated by reference.

TECHNICAL FIELD

This patent application relates to a bag, such as a backpack, that distributes weight over the back of a person.

BACKGROUND

FIG. 1 shows a human spine 100. The human spine 100 is divided into five sections. Section 102 is the cervical section; section 104 is the thoracic section; section 106 is the lumbar section; section 108 is the sacrum section; and section 110 is the coccyx section. As shown in FIG. 1, the human spine is naturally curved and its structures vary from section to section. For example, cervical section 102 includes discs having a relatively small size, whereas thoracic section 104, lumbar section 106, and sacrum section 108 include discs that have larger sizes. The sizes of the discs are indicative of the strength of the corresponding sections. Thus, cervical section 102 and thoracic section are not as strong as lumbar section 106, or sacrum section 108. Consequently, less weight can be borne on cervical section 102 or thoracic section 104 than on other sections of the back. If too much weight is borne by one particular section, for example, the thoracic section, injuries can result.

Weight from bags, such as backpacks and golf bags, is typically concentrated on one section of the spine. Back injuries can result, particularly if such bags are heavy. These injuries may include strained muscles and/or spinal injuries.

SUMMARY

In one aspect, an apparatus includes a bag to carry one or more objects on a back of a person and a cushion for connection to a surface of the bag. The cushion is used for making substantially continuous contact with the back when the bag is carried on the back. Implementations of the apparatus may include one or more of the following.

The substantially continuous contact of the apparatus may include contact in lumbar and sacral sections of the back. The cushion may be detachable relative to the bag or the cushion may be permanently attached to the bag. The cushion may be attached to the bag via an adhesive. The bag may be a backpack, a school bag, a golf bag, or a baby bag. The cushion may be made of micro-fiber, cotton, or Tempurpedic® material. The cushion may be inflatable or otherwise adjustable. The shape of the cushion may be circular or rectangular. The cushion may be more than 1 inch thick and less than 4 inches thick. The apparatus may include a wheeled device that is deployable and that is configured to support a weight of the bag. The wheeled device may include an adjustable rod and a wheel disposed at an end of the adjustable rod. The wheel in the wheeled device may comprise an omni wheel. The length of the wheeled device may be adjustable via the adjustable rod and it may include an activation switch to deploy the wheeled device. The wheeled device may also be made detachable from the apparatus.

In another aspect, described herein is an apparatus for carrying one or more objects on a back of a person. The apparatus includes a pack that is configured to hold the one or more objects and that has a top end and a bottom end, a handle that is attached to the top end, and straps that are connected to the handle and that are attached to the pack towards the bottom end of the pack. Implementations of the apparatus may include one or more of the following.

The apparatus may be a backpack. Locations where the shoulder straps are attached to the pack may be adjustable. The apparatus may include a device that is attachable to a surface of the pack and that has sufficient elasticity to conform to the contour of the back of the person. The device may include a cushion. The cushion may have a thickness of at least four inches.

In another aspect, an apparatus includes a pack to carry one or more objects on a back of a person, shoulder straps that are attached to the pack, a deployable wheeled device to support a weight of the pack, and a cushion for attachment to the pack. The cushion is configured to improve a load distribution of the one or more objects over the back. The apparatus may be a backpack. The shoulder straps may be attached to the top section of the pack. The shoulder straps may have shoulder pads that can be locked to specific positions, such as at the top of the shoulders of the person.

The details of one or more examples are set forth in the accompanying drawings and the description below. Further features, aspects, and advantages will become apparent from the description, the drawings, and the claims.

DETAILED DESCRIPTION

Figure 1:
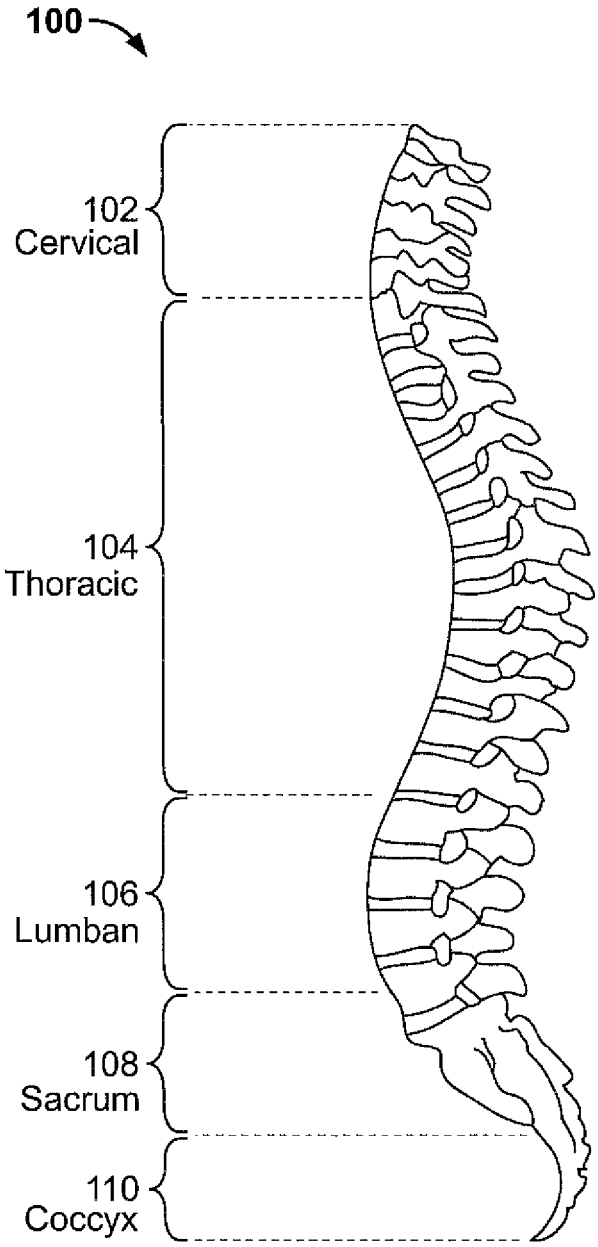
FIG. 1 shows an example of a human spine.
Figure 2:
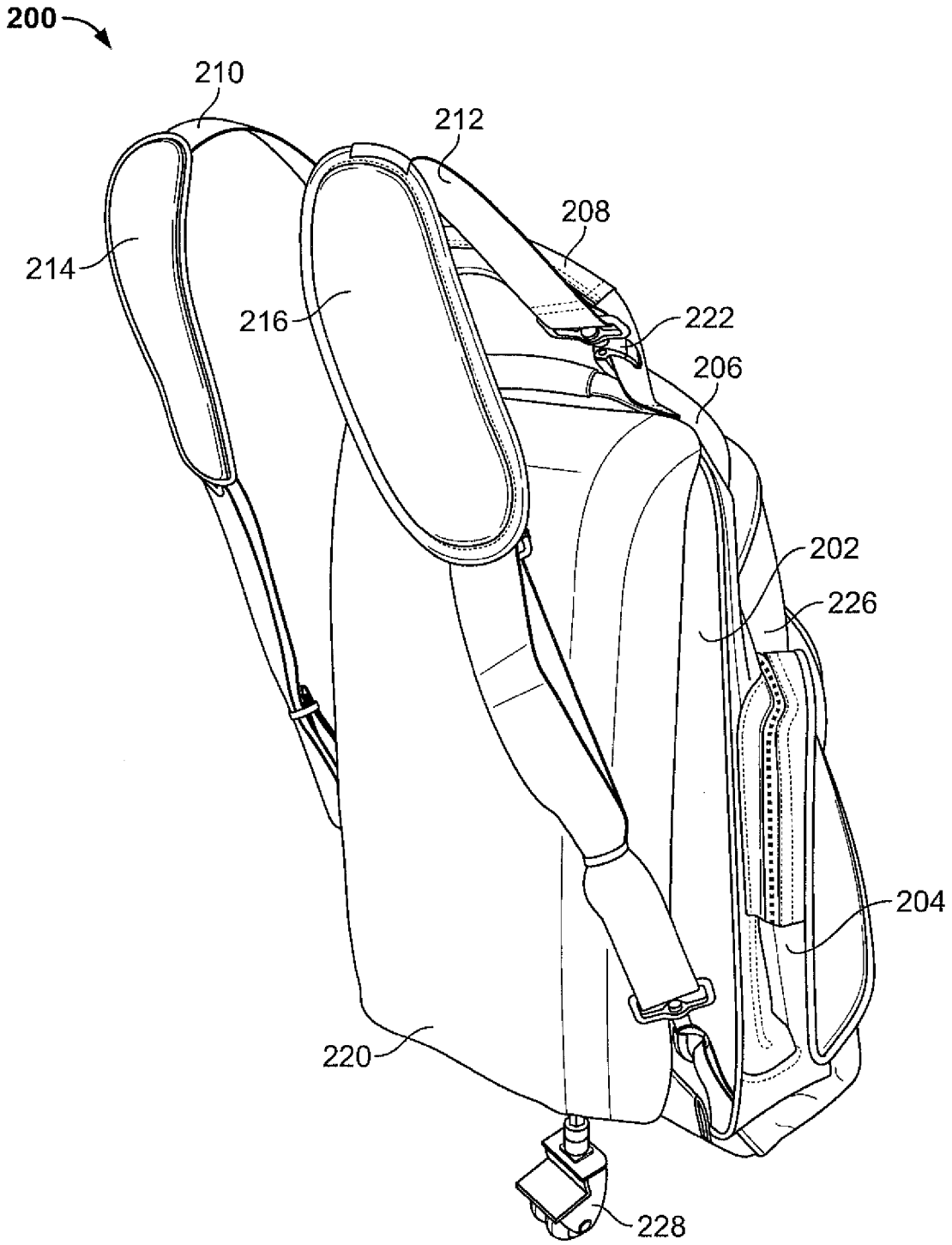
FIG. 2 shows an embodiment of a bag, which includes a cushion and shoulder straps, and which distributes weight over the back of a person.

FIG. 2 is an example of a bag that distributes weight over different areas of a person's back, including, e.g., the thoracic section, the lumbar section, and the sacrum section. As a result, the weight of the bag is not concentrated solely on any one section, thereby decreasing the likelihood of back injury.

In this example, the bag is a backpack 200. As shown in FIG. 2, backpack 200 includes a pack 226 for carrying one or more objects, a backend 202, a middle section 204, and a top 206. Backpack 200 also includes a handle 208 at its top, and shoulder straps 210 and 212, which may, or may not, be attached to top 206.

Backpack 200 also includes a cushion 220. Cushion 220 may be permanently attached to, or removable from, the backpack, as described below. Cushion 220 is curved, in this example, in order to roughly follow the contour of a human back. The cushion also has sufficient thickness and elasticity to substantially conform to the contour of the back upon application of forces (e.g., when pack 226 holds weight). For example, the thickness of cushion 220 may be in the range of 1 inches to 6 inches, but is not limited to that range. The cushion should also have an elasticity so it is soft enough to substantially conform to the contour of the back in response to applied weight, yet hard enough to support that weight against the back. That is, the cushion should be hard enough to distribute weight across the back from the thoracic section downward, e.g., to the lumbar section or lower. If the cushion were too thin, or too soft, weight in the pack might concentrate in one section of the back. The cushion need not always remain entirely flush against the back, but rather, the cushion should conform to a majority of the curvature of the person's back across the surface of the back.

Cushion 220 may include an outer cover made of cloth, felt, plastic, rubber, or any other type of material. Cushion 220 may include one or more different types of material in its interior. For example, cushion 220 may include micro-fiber, cotton, Tempurpedic®, natural, synthetic, and/or other types of materials. Cushion 220 may also include a zipper, buttons, Velcro®, or the like, which allows access to its interior. As such, the material included in the cushion may be replaced, removed, and/or supplemented.

Cushion 220, or a portion thereof, may be inflatable. For example, cushion 220 may include a plastic, air-inflatable bladder, with or without an outer cloth-like cover. The firmness of cushion 220 may be adjusted by addition or removal of air to or from the bladder. The firmness may be adjusted based on personal preference and/or the amount of weight being carried. For example, cushion 220 may need to be firmer to distribute heavier loads across the back of a person.

Figure 6A:
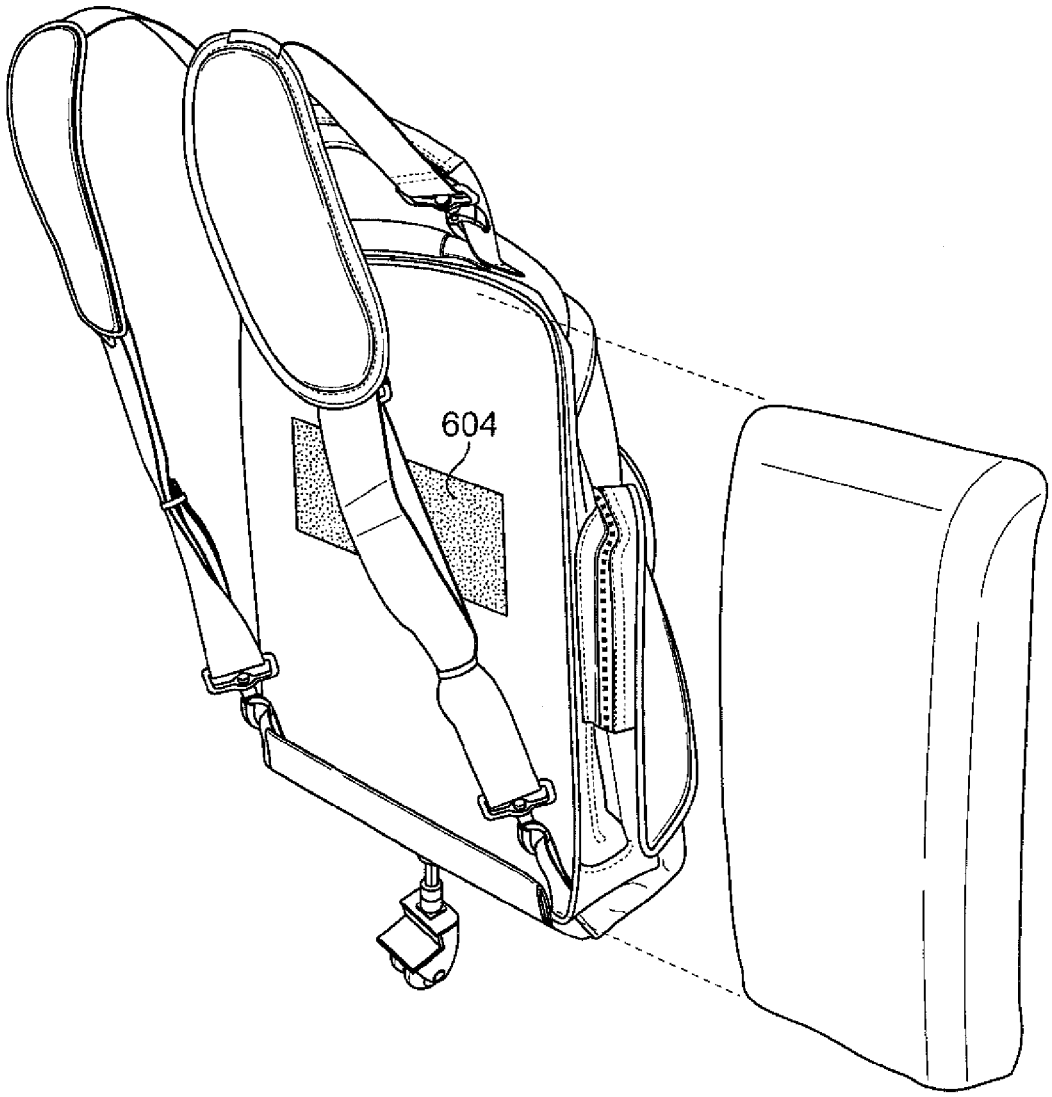
FIG. 6A shows detaching of the cushion from the bag.

As noted above, cushion 220 may be detachable from backpack 200, as shown in FIG. 6A. The cushion may be attached to, and thus detached from, the backpack using a variety of mechanisms. In the example of FIG. 6A, the backpack and cushion each have an adhesive patch (e.g., 604) attached to their respective surfaces. The adhesive patches allow the cushion to be attached to the backpack. The adhesive patches may be Velcro® or any other type of mutually-attachable material. In other embodiments, cushion 220 may be clipped to the backpack, hooked to the backpack, zippered to the backpack, or attached via any other mechanism. Mechanisms, such as these, for attaching and removing the cushion from the backpack allow the same backpack to be used with cushions having different shapes and/or sizes.

In this regard, cushion 220 may have any size or shape. For example, the cushion may be rectangular, square, oval, circular, trapezoidal and/or triangular. The size of the cushion may correspond to the surface area of the back of the backpack. For example, the cushion may exceed the surface area, may equal the surface area, or may be less than the surface area. For example, the cushion may be 100% of the surface area or more. Or the cushion may be just 80% of the surface area of the backpack. In some implementations, it may be desirable that the cushion be at least 50% of the surface area. But that is not required in all cases.

The cushion may be located in an area of the backpack that promotes weight distribution over the back of a person. For example, the cushion should be long enough to reach beyond the thoracic section, and, e.g., into the lumbar section, and/or sacrum section (or beyond). The cushion should also have sufficient width (in a direction from shoulder-to-shoulder) to promote weight distribution.

Examples of cushion dimensions include the following. For a cushion made for an adult of normal height (between four feet and six feet), the cushion may have a length of 18 inches (in a direction of the person's spine), a thickness of 3.5 inches, and a width of 11.25 inches at its widest part and 9.5 inches at its narrowest part. For a cushion made for a child whose height is between two feet and four feet, the cushion may have a length of 10 inches, a thickness of 3.5 inches at the thickest part, and a width of 11.25 inches or less. For a cushion made for a particularly tall person, e.g., from six to seven feet, the cushion should be made relatively long, e.g., 21 inches or possibly more. The height, thickness, and width of the cushion may vary or may be constant. For example, the cushion may have a middle portion that is thicker than other portions (see FIG. 6B).

The cushion may also be customizable to fit the contour of a person's back. For example, those with greater back contour may use cushions that are thicker and/or softer in order to enhance the likelihood that the cushion will conform, at least in part, to the person's back. Such people may also use cushions that have greater contours. That is, a first surface of the cushion that mates to the backpack is typically flat. The opposing surface may be curved relative to the first surface. The amount of curvature may be greater for people whose backs naturally have more curvature.

Figure 6B:
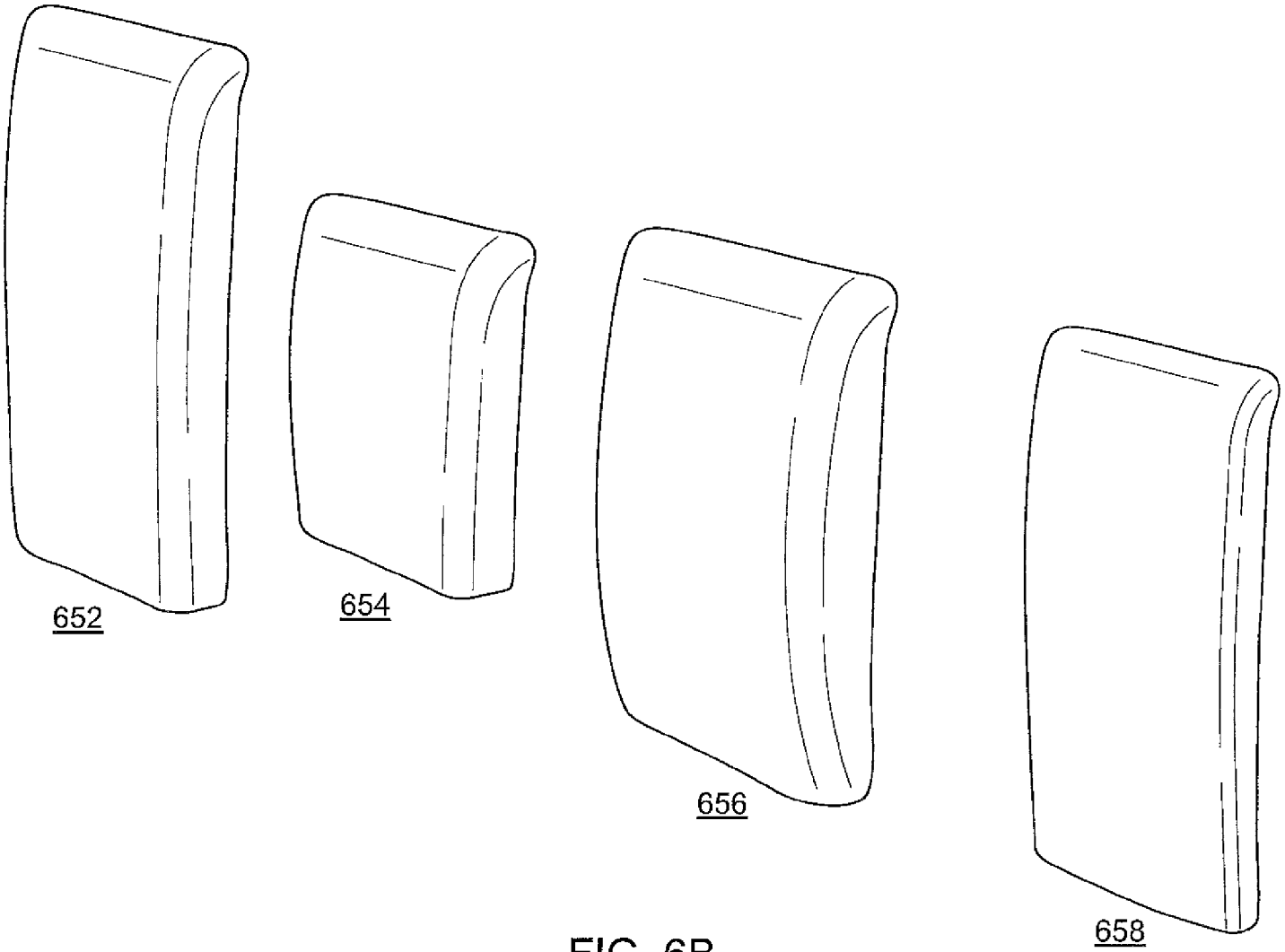
FIG. 6B shows different types of cushions that may be used in the bag.

FIG. 6B shows examples of different types of cushions that are made for different types of users. For example, a taller person may use a longer cushion, such as cushion 652, while a shorter person may use a shorter cushion, such as cushion 654. A person with a more curved back may use a thicker cushion, such as cushion 656. A person with a relatively straight back may use a thinner cushion, such as cushion 658.

As noted above, cushion 220 of backpack 200 may be shaped, at least partially, like the contour of a person's back. This, combined with the elasticity of the cushion, allows the cushion to conform to the contour of the person's back, and thereby distribute the load in pack 226 more evenly. In this regard, the pressure, P, caused by a force, F, exerted on a surface of area, A, can be expressed as:

$$P = \frac{F}{A} \tag{1}$$

Figure 3:
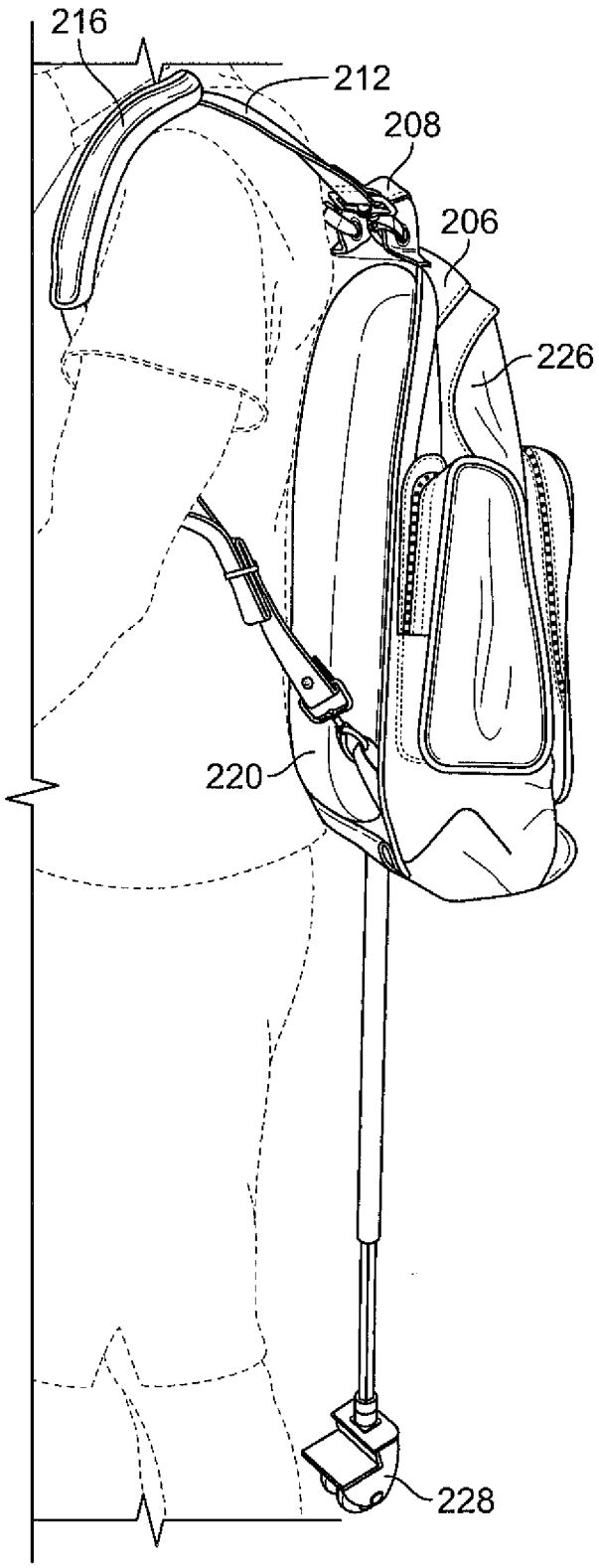
FIG. 3 shows a side view of a person in which the cushion of the bag is substantially flush against the contour of the person's back.

Thus, the larger the contact area is on the back, the smaller the pressure that results from the weight in the pack. When cushion 220 of backpack 200 is flush against the back of a person, as shown in FIG. 3, contact between the cushion and the back may be maximized, resulting in more even weight distribution over the back. It is noted, however, that the cushion of the bag described in this application need not always be flush against the back of a person. That is, weight distribution over the back will occur even in cases where the cushion is not in full contact (e.g., flush) with the back; however, generally speaking, full contact will result in greater weight distribution.

The configuration of the shoulder straps can also improve weight distribution over the back. First, referring to FIG. 2, shoulder straps 210 and 212 each include a shoulder pad, 214 and 216. The shoulder pads may be fixed so they stay on the top of the person's shoulders. But, the shoulder pads may be adjustable to accommodate different persons. This can be achieved by a locking mechanism that locks the shoulder pads to specific positions and that unlocks the shoulder pads to enable adjustment.

Figure 4:
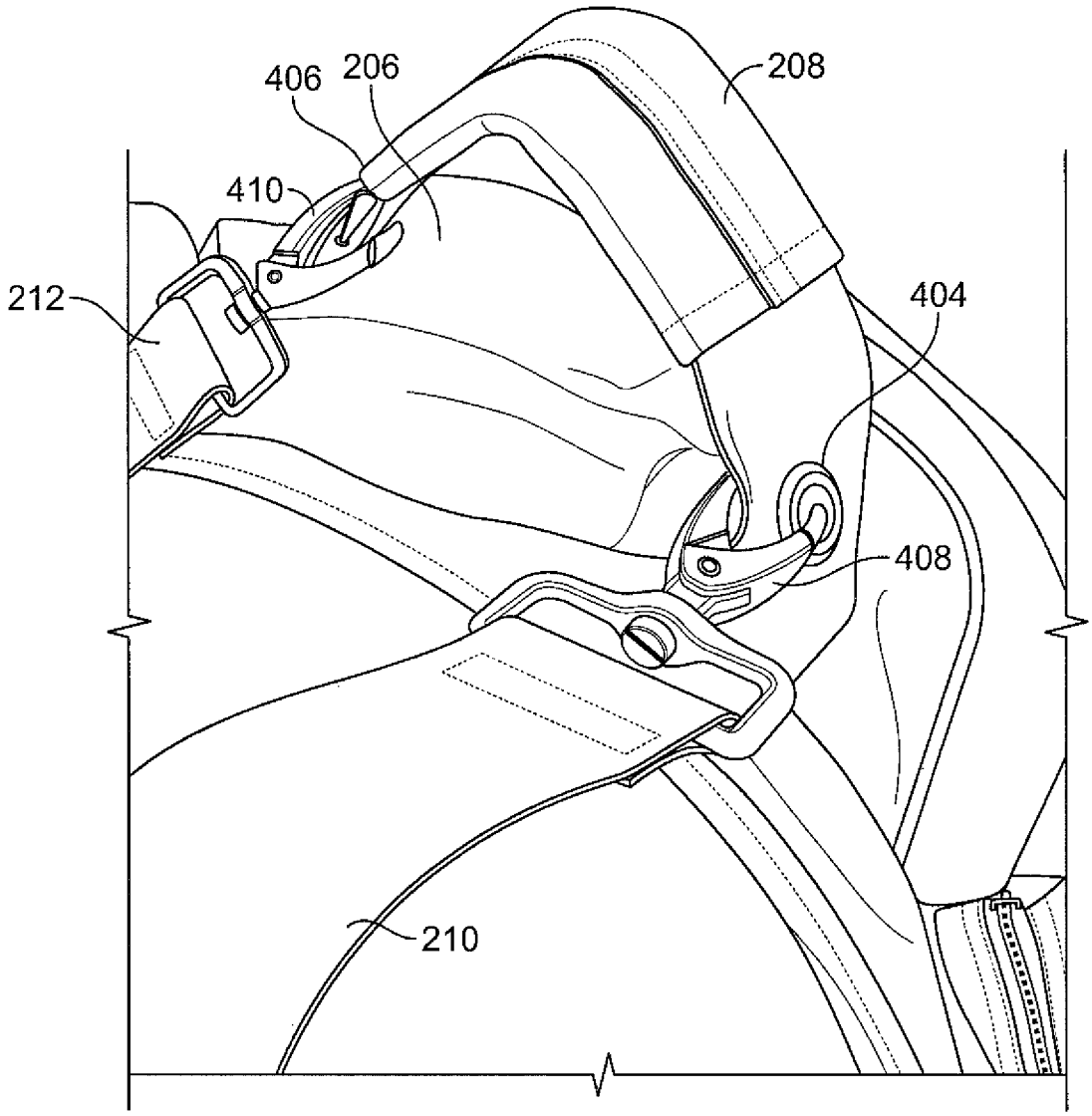
FIG. 4 shows an embodiment of the shoulder straps of the bag.

Referring to FIGS. 2 and 4, shoulder straps 210 and 212 may be attached to top section 206 (e.g., to handle 208). The shoulder straps may be permanently attached to the bag, or removable from the bag. The shoulder straps may be attached via snap hooks (e.g., 222). However, any type of attachment mechanism may be used. For example, the shoulder straps may be sewn to the bag, glued to the bag, and/or attached to the bag using Velcro® or other attachment mechanism(s). Alternatively, the shoulder straps and the bag may be parts of the same contiguous piece of material. Attaching the shoulder straps to the handle provides advantages relative to attaching the shoulder straps to other parts of the bag. For example, attaching the shoulder straps to the handle (or to other top parts of backpack 200) can prevent backpack 200 from falling significantly below the waist of the person carrying the backpack. It has been found that when a person carries a backpack that sits about four inches or more below the waist, that person may have to hunch in order to balance the weight of the backpack.

In the embodiment of FIG. 4, handle 208 includes rings 404 and 406. The shoulder straps include snap hooks 408 and 410, which may connect to the corresponding rings 404 and 406. In other embodiments, the handles may be attached to other parts of top section 206 and, as described above. The attachment between the handles and the top section may be via mechanisms other than the snap hooks that are shown.

Connection between the shoulder straps and the top section of backpack 200 can be adjustable. In this regard, users may be able to adjust the shoulder straps to fit their physical characteristics. For example, a larger person may prefer the shoulder straps to be farther apart, while smaller person may prefer the shoulder straps to be closer together. Appropriate mechanisms may be incorporated into the bag to enable such adjustment. For example, there may be multiple holes along handle 208, to which the snap hooks may connect in order to adjust the distance between the shoulder straps.

Figure 7A:
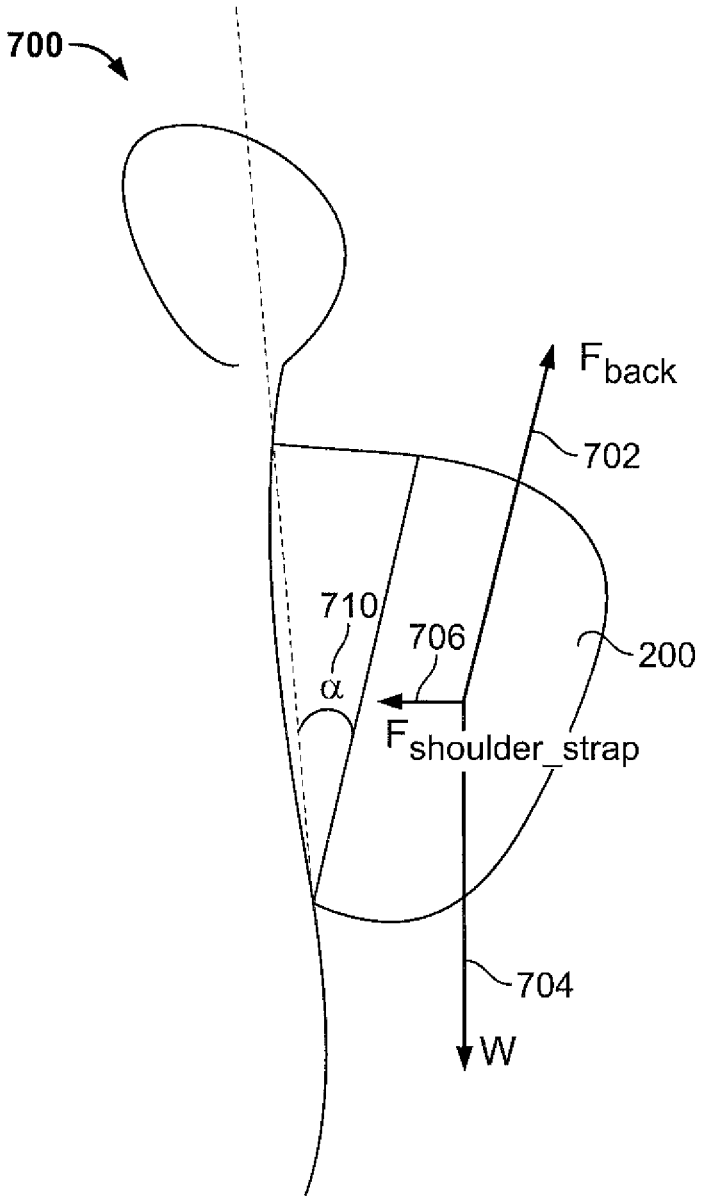
FIGS. 7A, 7B, and 7C show force diagrams.

When the shoulder straps are attached to the top of the backpack, the backpack may stay closer to the back when carried. Referring to FIG. 7A, this may result in a smaller angle $\alpha$, 710, between the back part of the backpack and the person's back. In FIG. 7A, force 702, $F_{back}$, is the force exerted by the back muscle on the backpack. Force 702 equals in magnitude the force exerted by the backpack on the back. Force 706, $F_{shoulder_strap}$, is the force exerted on the backpack by the shoulder straps. Force 704, W, is the weight of the backpack. The three forces, W, $F_{back}$, and $F_{shoulder_strap}$, act together on the backpack and should be in equilibrium.

Figure 7B:
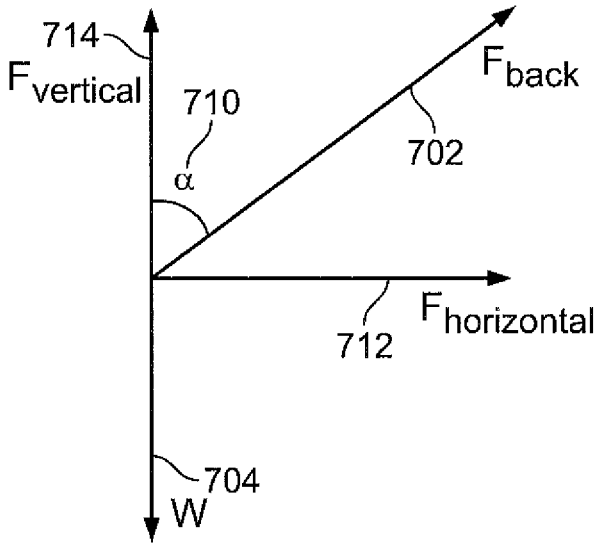
Figure 7C:
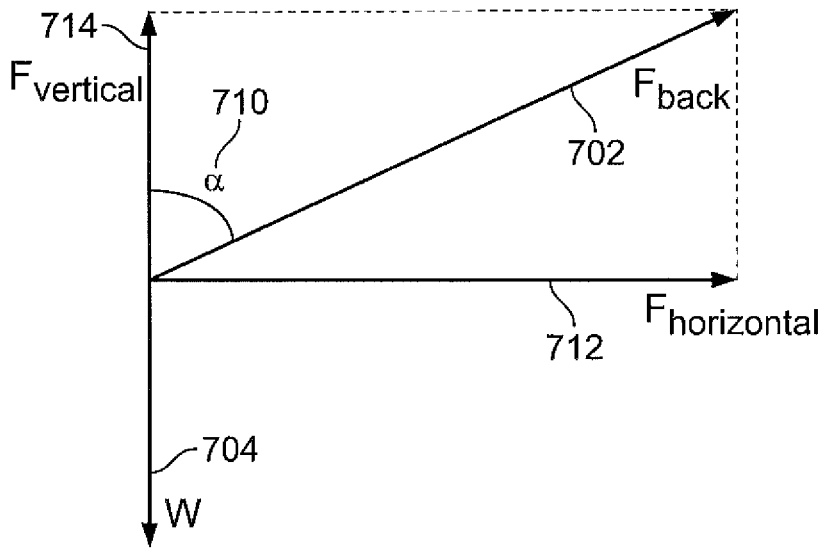
Figure 7D:
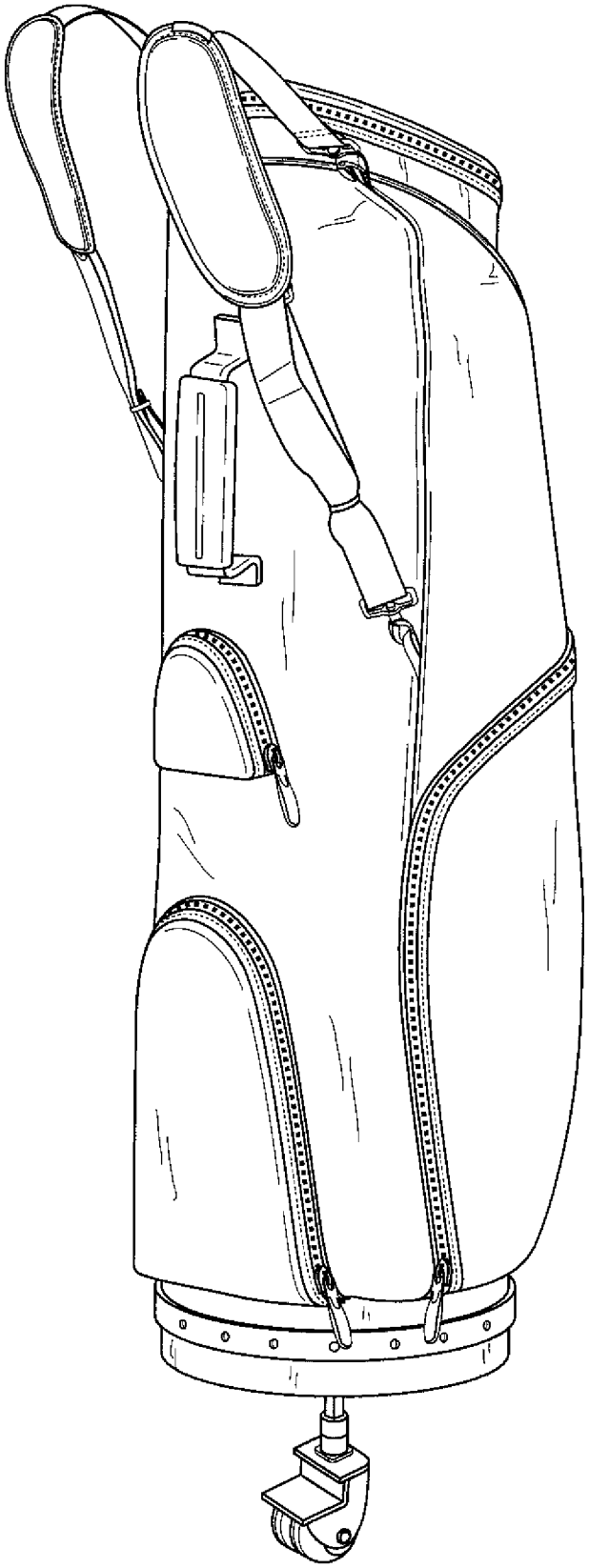
FIG. 7D shows a golf bag.
Figure 7E:
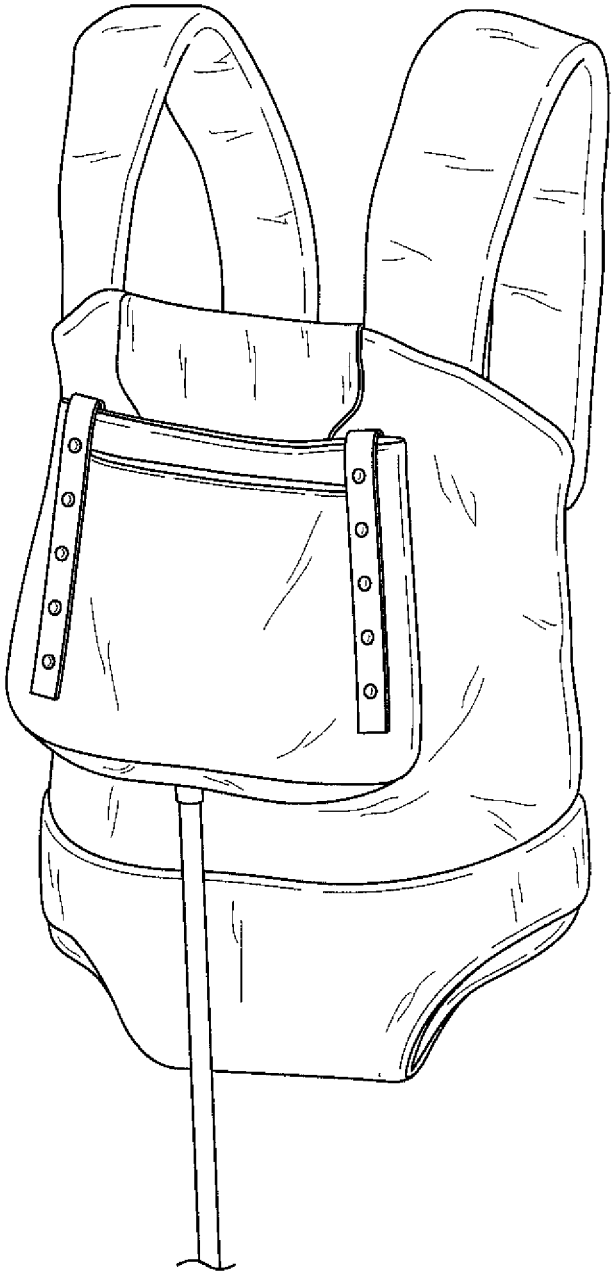
FIG. 7E shows a baby bag.

Referring to FIGS. 7B and 7C, $F_{horizontal}$ is the horizontal component of $F_{back}$ and should be equal to force 706, $F_{shoulder_strap}$, in FIG. 7A in magnitude. When the weight of the backpack remains constant, $F_{back}$ increases as the angle $\alpha$ increases, as shown in FIGS. 7B and 7C. $F_{vertical}$ remains constant in order to counterbalance the weight of the backpack irrespective of the angle $\alpha$. To keep $F_{vertical}$ constant, $F_{back}$ in FIG. 7C needs to be larger than $F_{back}$ in FIG. 7B. Therefore, the larger the angle $\alpha$ is, the larger $F_{back}$ is. The configuration of shoulder straps 210 and 212 shown in FIG. 2 results in a smaller force acting on the person's back, hence less pressure.

In an implementation, backpack 200 can reduce the pressure on a person's back that results from load in the pack by about 50% relative to a conventional backpack.

Referring back to FIGS. 2 and 3, backpack 200 may include a wheeled device 228. The wheeled device may be deployed when the backpack is dragged on the ground, e.g., by the handle, as shown in FIG. 5B. Alternatively, the wheeled device may be deployed to support the backpack while it is being carried on the back of a person.

Figure 5A:
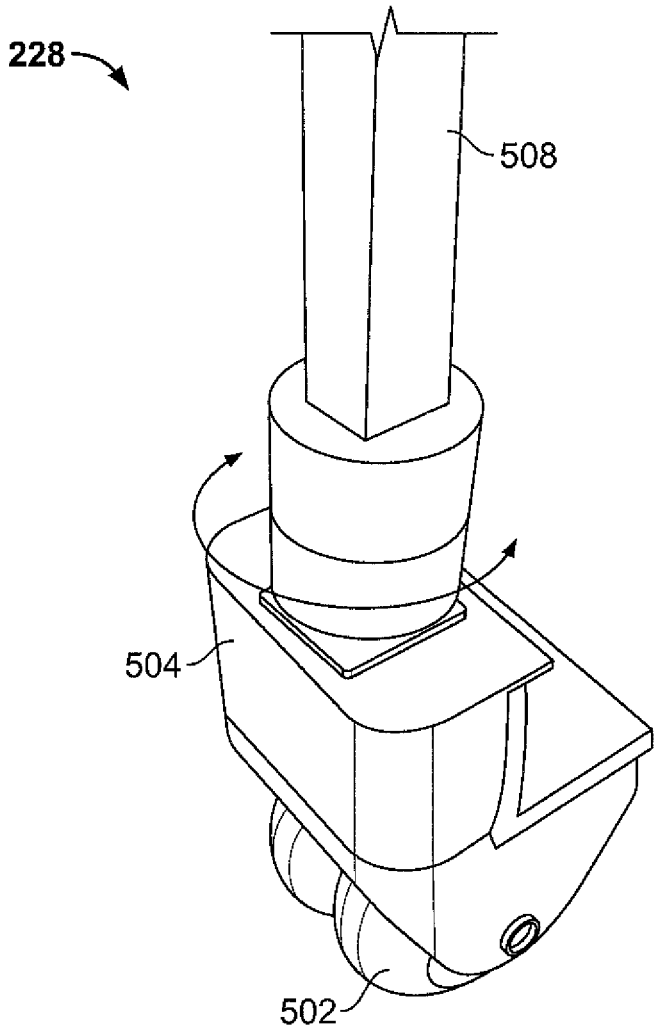
FIG. 5A shows an embodiment of a wheeled device, which may be included in the bag.
Figure 5B:
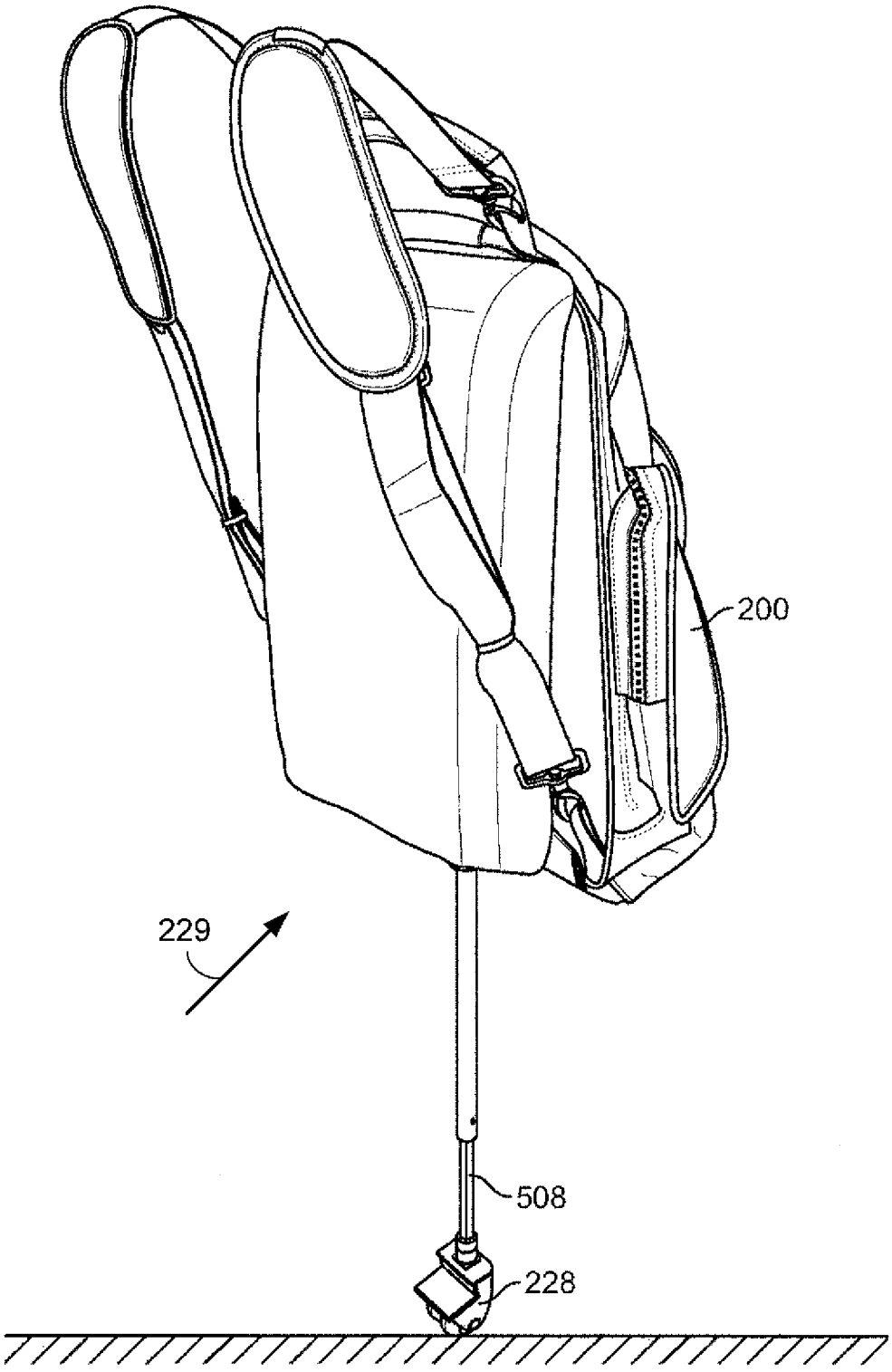
FIG. 5B shows extension of the wheeled device.

FIG. 5A shows a close-up of part of wheeled device 228. In this embodiment, the wheeled device includes a wheel 502, a socket 504, and a rod 508 that physically connects the wheel/socket to backpack 200. Rod 508 may be located between cushion 220 and backend 202 of the backpack. Alternatively, rod 508 may be located elsewhere. For example, rod 508 can be located behind backend 202, i.e., inside backpack 200. The bottom of the backpack can also be configured to accommodate rod 508.

Figure 5C:
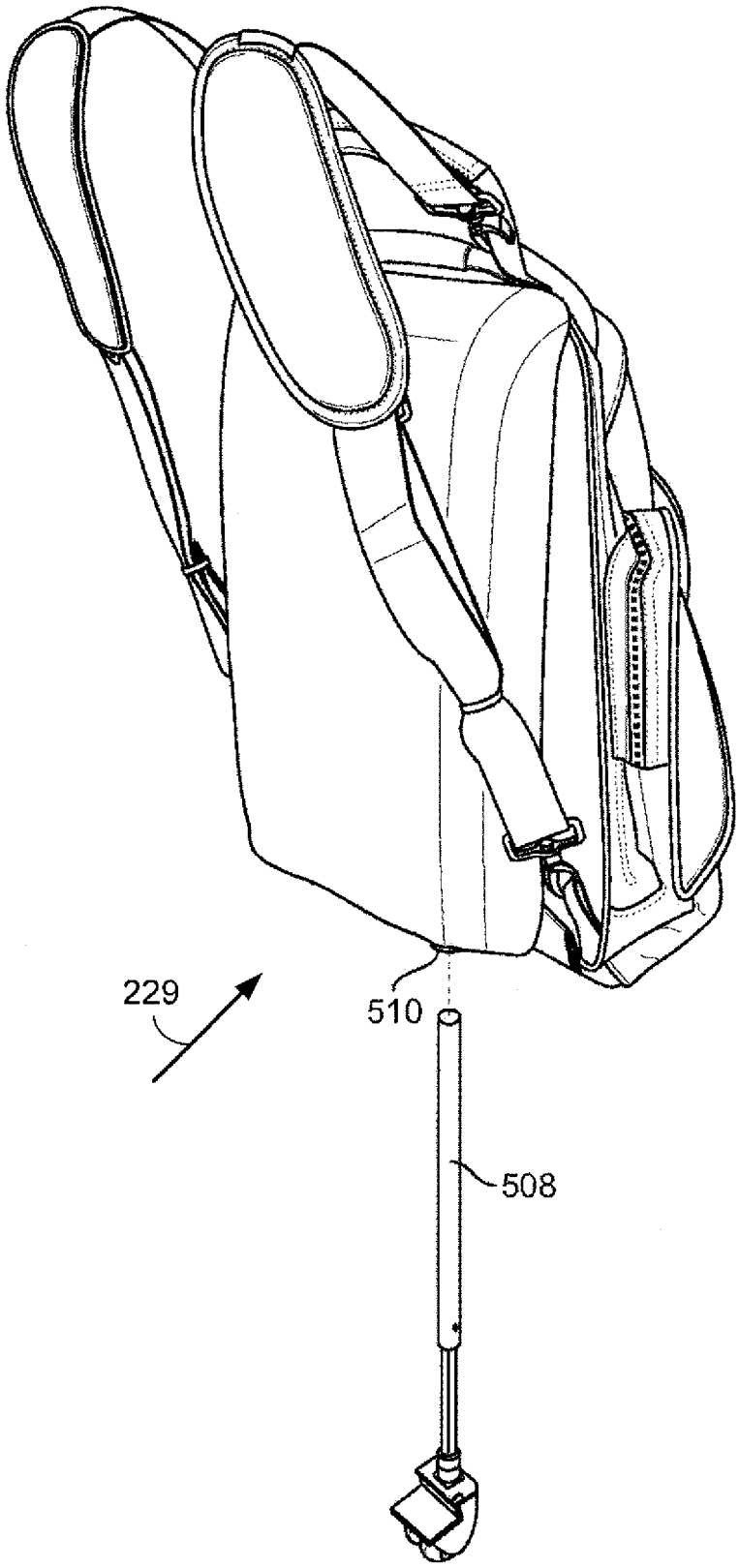
FIG. 5C shows detaching of the wheeled device from the bag.

Wheeled device 228 may be permanently attached to the backpack, or it may be detachable therefrom. For example, as shown in FIG. 5C, rod 508 may be attached to/detached from a corresponding matching portion 510, which itself may be permanently attached to, or detachable from, the backpack. Rod 508 may telescope to adjust to a particular length, thereby accommodating people of different heights and arm lengths. Alternatively, the rod may fold-out to adjust its length and/or there may be additional sections that are addable to, or removable from, the rod to adjust its length. Furthermore, an activation switch (indicated generally, e.g. in FIGS. 5B and 5C, by arrow 229) may be used to deploy the wheeled device. A user can simply press the switch to release the rod. The length of the deployed portion of the rod may be pre-configured. The length of the deployed portion of the rod may also be configured to be dependent on how long the user presses the switch. It is noted that any combination of these, or other, mechanisms may be used to adjust the length of the rod.

As explained above, using the wheeled device, backpack 300 can be pulled along on the ground, as shown in FIG. 5B. Alternatively, rod 508 can be adjusted so that, when a person carries backpack 200 on the back, rod 508 can extend to allow the wheel to touch the ground and thereby accommodate weight that may otherwise be borne on the person's back and shoulders. To this end, the wheeled device may include a shock absorber or similar device that moves vertically to track the terrain. For example, the rod may include an outer portion and an inner portion. The inner portion may move relative to the outer portion to track the terrain.

Referring to FIG. 5A, socket 504 can swivel around rod 508, allowing the wheel to swivel while being pulled. Other types of wheels, such as an omni wheel, can be used instead of the socket shown in FIG. 5A. The wheels used in the wheeled device 228 can be made of different materials, such as light weight plastics, heavy duty plastics, stainless steel, or any other materials. The wheels can be different sizes too, for example, different diameters and/or thicknesses. The wheeled device 228 may include one wheel, as shown, or more than one wheel. There may be more than one wheeled device on a single bag.

The above discussed features can be applied equally to other load-carrying bags, including, but not limited to, golf bags, baby packs/bags, baby carriers, military packs, mail carriers' bags, children's backpacks, laptop cases, and leaf blowers.

Elements of different implementations may be combined, or removed, to produce implementations not specifically described herein.

A number of implementations have been described. Nevertheless, it will be understood that various modifications may be made without departing from the spirit and scope of this disclosure. Accordingly, other implementations are within the scope of the following claims.

What is claimed is:

1. An apparatus comprising:

a bag to carry one or more objects on a back of a person, the bag having a bottom horizontal surface;

a central wheeled device that is deployable from the bag while the bag is worn on the back of the person, the central wheeled device comprising:

a wheel;

a rod having a first end connected to the wheel; and a matching portion for accepting a second end of the rod, the matching portion located substantially in the middle of the bottom horizontal surface of the bag; and an activation switch to deploy the central wheeled device from a stored position to a deployed position;

wherein the wheel resides adjacent to the matching portion when the central wheeled device is in the stored position, and wherein the central wheeled device is configured to make contact with the ground to support at least a portion of a weight of the bag while the bag is worn on the back of the person when the central wheeled device is in the deployed position, and wherein the bag is one of the group consisting of a backpack, a school bag, a golf bag, and a baby bag.

2. The apparatus of claim 1, wherein the wheel comprises an omni wheel.

3. The apparatus of claim 1, wherein a length of the central wheeled device is adjustable via the rod.

4. The apparatus of claim 1, wherein at least part of the central wheeled device is detachable from the apparatus.

5. An apparatus for carrying one or more objects on a back of a person, the apparatus comprising:

a pack configured to hold the one or more objects, the pack having a top end and a bottom end having a bottom horizontal surface;

a handle attached to the top end of the pack, the handle having two rings on opposite lateral ends of the handle;

two straps having first ends that are attached to the two rings of the handle and second ends that are attached to the pack towards the bottom end of the pack;

a central wheeled device that is deployable from the pack while the pack is worn on the back of the person, the central wheeled device comprising:

a wheel;

a rod having a first end connected to the wheel; and a matching portion for accepting a second end of the rod, the matching portion located on the bottom horizontal surface of the pack; and an activation switch to deploy the central wheeled device from a stored position to a deployed position;

wherein the wheel resides adjacent to the matching portion when the central wheeled device is in the stored position, and wherein the central wheeled device is configured to make contact with the ground to support at least a portion of a weight of the pack while the pack is worn on the back of the person when the central wheeled device is in the deployed position.

6. The apparatus of claim 5, wherein the apparatus comprises a backpack.

7. The apparatus of claim 5, further comprising a device for connection to a back surface of the pack, the device having sufficient elasticity to conform to a contour of the back of the person.

8. The apparatus of claim 7, wherein the device comprises a cushion.

9. The apparatus of claim 8, wherein the cushion has a thickness of at least one inch.

10. A backpack for carrying one or more objects on a back of a person, the apparatus comprising:

a pack configured to hold the one or more objects, the pack having a back surface, a top end and a bottom end having a bottom horizontal surface;

a cushion for connection to the back surface of the pack, the cushion for making substantially continuous contact with the back when the pack is carried on the back;

a handle attached to the top end of the pack;

two shoulder straps having first ends that are attached to the handle and second ends that are attached to the pack towards the bottom end of the pack such that, when the pack is worn on the back of the person, an angle between the cushion and the back is sufficiently small to cause the force exerted on the back to be reduced by 50% relative to a conventional backpack;

a central wheeled device that is deployable from the pack while the pack is worn on the back of the person, the central wheeled device comprising:

an omni wheel;

a rod having a first end connected to the wheel; and a matching portion for accepting a second end of the rod, the matching portion located on the bottom horizontal surface of the pack; and an activation switch to deploy the central wheeled device from a stored position to a deployed position;

wherein the wheel resides adjacent to the matching portion when the central wheeled device is in the stored position, and wherein the central wheeled device is configured to make contact with the ground to support at least a portion of a weight of the pack while the pack is worn on the back of the person when the central wheeled device is in the deployed position.

11. The backpack of claim 10, wherein lengths of the shoulder straps are adjustable.

12. The backpack of claim 10, wherein the cushion comprises micro-fiber.

13. The backpack of claim 10, wherein the cushion comprises cotton.

14. The backpack of claim 10, wherein the cushion is inflatable.

15. The backpack of claim 10, wherein the cushion comprises memory foam material.

16. The backpack of claim 10, wherein the cushion is attached to the pack via an adhesive.

17. The backpack of claim 10, wherein the cushion is adjustable.

18. The backpack of claim 10, wherein the shape of the cushion is circular.

19. The backpack of claim 10, wherein the shape of the cushion is rectangular.

20. The backpack of claim 10, wherein a thickness of the cushion is more than 1 inch.

21. The backpack of claim 10, wherein a thickness of the cushion is less than 4 inches.

22. The backpack of claim 10, wherein the shoulder straps have shoulder pads that can be locked to specific positions.

23. The backpack of claim 22, wherein the specific positions are at the top of the shoulders of the person.

* * * * *